United States Patent [19]

Inoue

[11] 4,453,799

[45] Jun. 12, 1984

[54] FEMALE ELECTRIC CONNECTOR

[75] Inventor: Nori Inoue, Suzuka, Japan

[73] Assignee: Tokai Electric Wire Company Limited, Yokkaichi, Japan

[21] Appl. No.: 378,721

[22] Filed: May 17, 1982

[30] Foreign Application Priority Data

Feb. 10, 1981 [JP] Japan ..... 56/17430

[51] Int. Cl.[3] ..... H01R 11/22

[52] U.S. Cl. ..... 339/256 SP; 339/258 S

[58] Field of Search ..... 339/258 R, 258 P, 258 S, 339/256 SP, 32, 33, 258 F, 19

[56] References Cited

U.S. PATENT DOCUMENTS

| | | | |
|---|---|---|---|
| 3,874,769 | 4/1975 | Simon | 339/258 R |
| 3,917,371 | 11/1975 | Hirokawa et al. | 339/19 |
| 3,947,083 | 3/1976 | Ahmed et al. | 335/258 P |

FOREIGN PATENT DOCUMENTS

| | | | |
|---|---|---|---|
| 54-15170 | 6/1979 | Japan | 339/19 |
| 55-2038 | 1/1980 | Japan | 339/19 |
| 1113856 | 5/1968 | United Kingdom | 339/258 S |

*Primary Examiner*—William P. Briggs

*Attorney, Agent, or Firm*—Cushman, Darby & Cushman

[57] ABSTRACT

A female electric connector for receiving a male contactor to achieve an electric connection to the male contactor. The female electric connector has an electric wire connecting portion and a receptacle portion extending forwardly from the connecting portion and having a box-like construction. The receptacle portion includes a bottom wall connected to and extending forwardly from the front end of the electric wire connecting portion, a pair of side walls extending substantially upright from both side edges of the bottom wall, and an upper wall constituted by a pair of upper wall parts extending toward each other from the upper edges of respective side walls. The side walls constitute a first pair of opposing walls of the receptacle portion while the bottom wall and the upper wall in combination constitute a second pair of opposing walls of the receptacle portion. A pair of slits for receiving a male electric contactor are formed in the opposing wall of either the first pair or the second pair to extend rearwardly from the front ends of these walls. At least a resilient contactor is connected to the front end of one of the opposing walls of the other pair and is bent backwardly to extend longitudinally and rearwardly in the receptacle portion. The resilient contactor makes, when the male electric contactor is inserted into the slits, a resilient contact with the male electric contactor to firmly hold the same in the slits to ensure a stable electric connection between the male contactor and the female connector.

3 Claims, 9 Drawing Figures

FEMALE ELECTRIC CONNECTOR

FIELD OF THE INVENTION

The present invention relates to an electric connector for use as a member for electrically connecting electric wires and, more particularly, to a female electric connector for completing an electric connection by receiving therein an electric contact piece constituting a male electric contactor.

DESCRIPTION OF THE PRIOR ART

Figure 1:
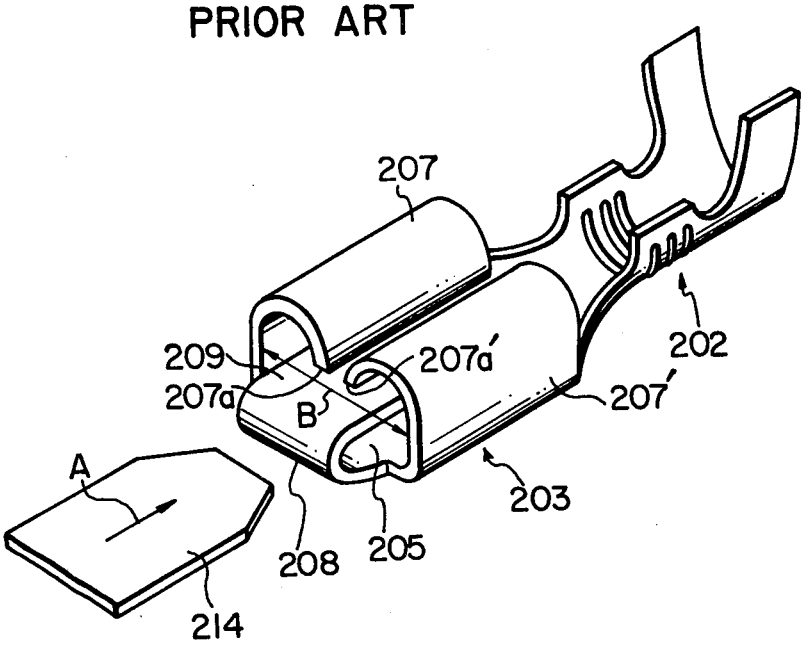
FIG. 1 PRIOR ART
FIG. 1 is a perspective view of an example of a conventional female electric connector.

FIG. 1 shows an example of a conventional female electric connector. This female electric connector has a receptacle portion 203 adapted to receive a male electric contactor 214 and an electric wire connecting portion 202 provided behind the receptacle portion and adapted to be connected to one end of an electric wire. The receptacle portion 203 has a bottom wall 205, a resilient tongue 209 connected to the front end of the bottom wall 205 and extending rearwardly therefrom through a bent portion 208, and a pair of side walls 207,207' standing upright from both side edges of the bottom wall 205 and having free ends **207*a*,207*a*' bent to oppose to the upper surface of the tongue 209. In the use of the conventional female electric connector having the described construction, the male electric contactor 214 is inserted into the space between the free ends 207*a*,207*a*' of the side walls 207, 207' and the upper surface of the tongue 209 in the direction of the arrow A. In consequence, the contactor 214 is firmly clamped between the tongue 209 and the free ends 207*a*,207*a*'** to achieve a stable electric connection between the male contactor and the female connector.

This known female electric connector, however, has the following disadvantage. Namely, this female connector cannot apply generally to male electric contactors of a large variety of widths. Namely, in the known female electric connector of the kind described, it is not possible to insert into the receptacle 203 a male electric connector having a width greater than the distance B between opposing inner surfaces of the side walls.

SUMMARY OF THE INVENTION

Accordingly, it is a primary object of the invention to provide a female electric connector capable of achieving an electric connection to various male electric contactors of a large variety of widths, particularly male electric connectors having a large breadth, by receiving such male electric contactors.

To this end, according to the invention, there is provided a female electric connector having an electric wire connecting portion and a receptacle portion connected to the front side of the electric wire connecting portion, wherein the receptacle portion includes: a bottom wall connected to the front end of the electric wire connecting portion and extending forwardly therefrom, a pair of side walls standing substantially upright from both side edges of the bottom wall, an upper wall consisting of a pair of upper wall parts extending from the upper edges of both side walls toward each other and opposing to the bottom wall, the side walls constituting a first pair of opposing walls of the receptacle portion while the bottom wall and the upper wall constituting a second pair of opposing walls of the receptacle portion, a pair of slits formed in either one of the first and second pairs of opposing walls and extending rearwardly from the front ends of the opposing walls over a predetermined length substantially in alignment with each other, and at least one resilient contactor connected to the front end of at least one of the walls constituting the other pair of opposing walls, the resilient contactor being bent inwardly of the receptacle portion and then extended longitudinally and rearwardly in the receptacle portion, the resilient contactor being adapted to make, when a male contactor is inserted into said slits, a resilient contact with the male electric connector to hold the same in the slits.

The above and other objects, features and advantages of the invention will become clear from the following description of the preferred embodiments taken in conjunction with the accompanying FIGS. 2 thru 6.

DESCRIPTION OF THE PREFERRED EMBODIMENTS

Figure 2:
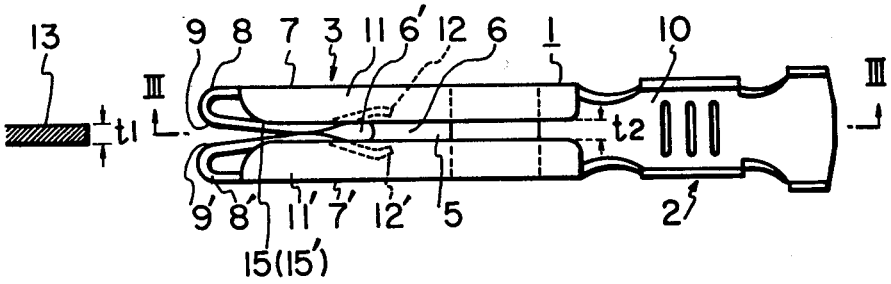
FIG. 2 is a plan view of a female electric connector of a first embodiment of the invention.
Figure 3:
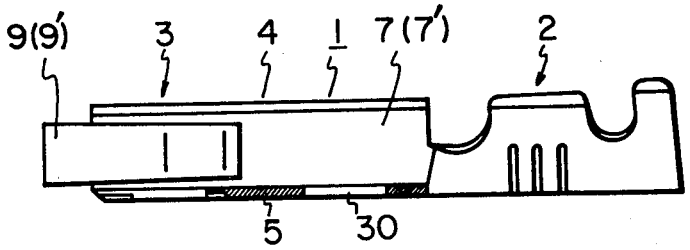
FIG. 3 is a sectional view taken along the line III—III of FIG. 2.
Figure 4:
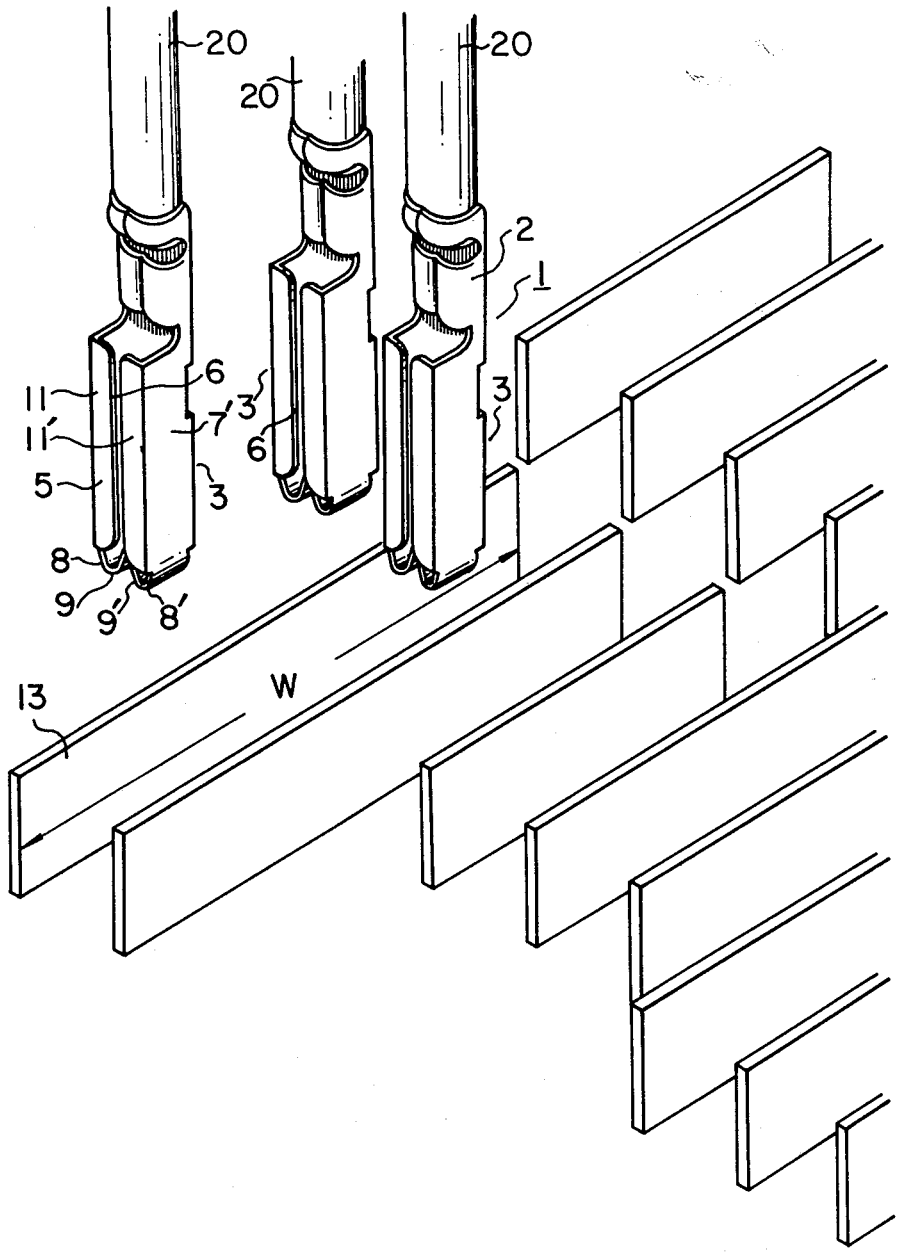
FIG. 4 is an illustration of the electric connector of the first embodiment in the state of use.

Referring first to FIGS. 2 thru 4, a female electric connector of the first embodiment generally designated at a reference numeral 1 has an electric wire connecting portion 2 adapted to be connected to an electric wire 20 by embracing and clamping one end of the electric wire 20, and an electric contact portion or a box-like receptacle portion 3 adapted to receive a male electric connector, i.e. an electric contactor 13. The box-like receptacle portion 3 has a bottom wall 5 continueing from the bottom 10 of the connecting portion 2 longitudinally and forwardly (leftwardly as viewed in FIG. 2), a pair of side walls 7,7' standing substantially upright from both side edges of the bottom wall 5, and an upper wall consisting of a pair of upper wall parts 11,11' extending toward each other from the upper end edges of both side walls 7,7'.

The bottom wall 5 and the upper wall 11,11' in combination constitute a first pair of opposing walls of the receptacle portion 3 while the side walls 7,7' constitute a second pair of opposing walls of the receptacle portion 3. In the first embodiment of the invention, a pair of slits 6,6' are formed in the walls of the first pair to extend rearwardly from the front edges of these walls over a predetermined length substantially in alignment with each other. More specifically, the inner edge of the upper wall part 11 and the inner edge of the upper wall part 11' are made to oppose to each other with a small distance from each other to define the slit 6 therebetween. On the other hand, the slit 6' is formed by cutting in the bottom wall 5 from the front end (left end as viewed in FIG. 2) toward the electric wire connecting portion 2 over a predetermined length, substantially in alignment with the slit 6.

Contactors 9 and 9' extend from the front ends (left end as viewed in FIG. 2) of the side walls 7 and 7'. Namely, these contactors 9 and 9' extend from the front ends of the side walls 7 and 7' forwardly over a small distance and are then bent downwardly and upwardly as viewed in FIG. 2, respectively, as at bent portions 8 and 8' and are then extended rearwardly as viewed in FIG. 2 into the receptacle portion 3. These contactors 9 and 9' are so arranged that the gap formed between these contactors 9,9' is gradually decreased in the region between the front ends of the contactors 9,9' and the substantially mid point between the front ends and the free ends 12,12' of the contactors 9,9' and then gradually increased in the region between the mid point and the free ends 12,12', as will be clearly seen from FIG. 2.

Thus, a wedge-shaped gap converging rearwardly from the front end is formed between the contactors 9 and 9'. It is, therefore, possible to easily and smoothly insert the electric contactor 13 into the space between two contactors 9 and 9'. The size of clearance of each slit 6 or 6' is increaing at the front end of the slit to form a guide portion 15 or 15'. The guide portions 15 and 15' function to prevent the insertion of the electric contactor 13 at wrong angle or posture into the space between the contact pieces 9 and 9'.

The clearance ($t_2$) of the slit 6,6' is slightly greater than the thickness ($t_1$) of the electric contactor 13. The insertion of electric contactor 13 at wrong angle or posture into the space between the contactors 9,9' through the slits 6,6' is prevented also by this arrangement.

In the female electric connector of the first embodiment having the described construction, one 6 of the slits is defined between the inner edge of the upper wall part 11 and the opposing inner edge of the other upper wall part 11', while the other slit 6' is formed in the bottom wall 5 so as to be aligned with the slit 6. It is, therefore, possible to insert various male electric contactors of a large variety of breadths exceeding that of the box-like receptacle 3, through the slits 6,6' and the space between the contactors 9 and 9' into the receptacle portion 3. After the insertion, the electric contactor 13 is securely clamped and fixed by the resilient force exerted by the contactors 9 and 9'. Namely, it is possible to receive, for example, a male electric contactor 13 having a large width was shown in FIG. 4 and to achieve a perfect electric connection between the male electric contactor 13 and the female electric connector. The box-like form of the receptacle portion 3 provides a considerable rigidity of the receptacle portion 3.

Figure 5:
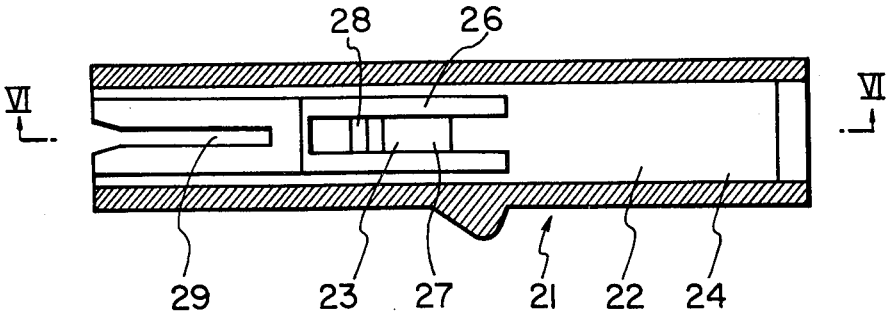
FIG. 5 is a partly sectioned top plan view of a connector housing.
Figure 6:
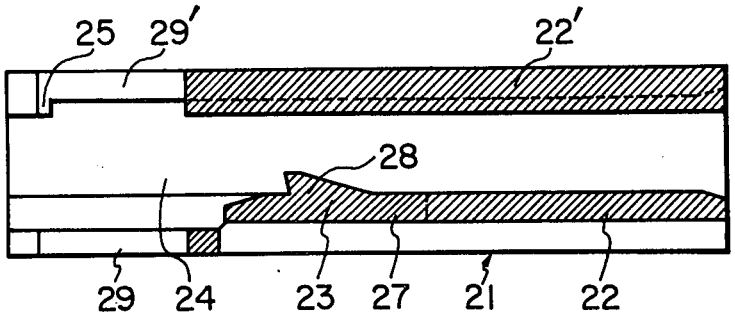
FIG. 6 is a sectional view taken along the line VI—VI of FIG. 5.

FIGS. 5 and 6 shows a connector housing 21 for accomodating the female electric connector 1. The housing 21 has a bottom wall 22 and an top wall 22' opposing to each other. The bottom wall 22 and the top wall are provided with notches 29 and 29' formed in the front ends thereof. A lance 23 is formed on the bottom wall 22. A projection 25 is formed on the open end edge of the top wall 22' to project into the cavity 24. The lance 23 is formed by cutting the bottom wall 22, and has an arm portion 27 extending into the space formed as a result of cutting and a projection 28 projecting into the cavity 24.

Figure 7:
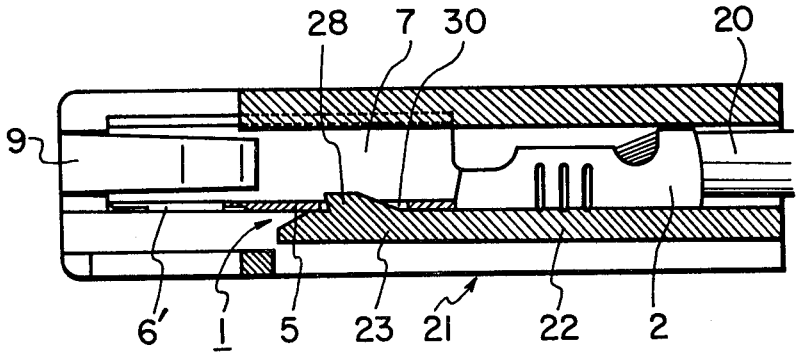
FIG. 7 is a longitudinal sectional view of a connector housing receiving a male electric connector.

For mounting a female electric connector 1 in the housing 21 shown in FIGS. 5 and 6, the electric connector 1 is inserted from the right side to the left side into the housing 21 as viewed in FIGS. 5 and 6, such that the bottom wall 5 of the female electric connector 1 slides on the inner surface of the bottom wall 22 of the housing 21, until the projection 28 of the lance fits in the hole 30 formed in the bottom wall 5 of the electric connector 1, as will be seen from FIG. 7.

Although the housing 21 is not shown in FIG. 4, the electric connector 1 is mounted in the housing 21 when it actually receives the male electric contactor 13 for achieving electric connection with the male electric contactor 13. In the state in which the electric contactor 13 is mounted in the housing 21, the notches 29,29' formed in the housing 21 are aligned with the slits 6,6' in the electric connector 1 to permit the insertion of the electric contactor 13 into the slits 6,6'.

Figure 8:
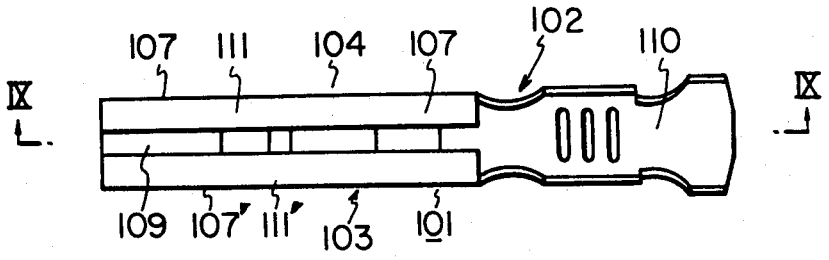
FIG. 8 is a plan view of an electric connector in accordance with a second embodiment of the invention.
Figure 9:
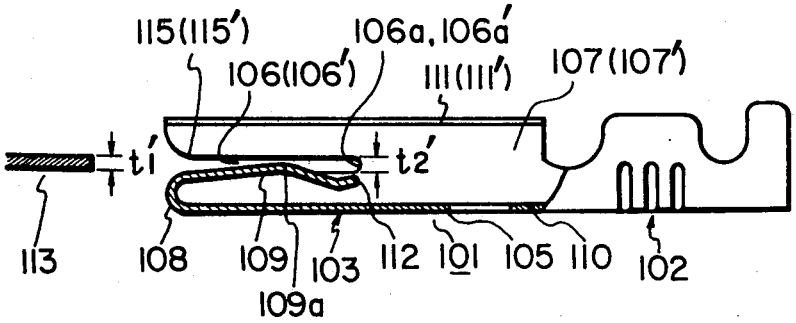
FIG. 9 is a sectional view taken along the line IX—IX of FIG. 8.

FIGS. 8 and 9 show a second embodiment of the invention. As in the case of the electric connector 1 of the first embodiment, the electric connector 101 of the second embodiment has an electric wire connecting portion 102 and a box-like receptacle portion 103 for receiving a male electric contactor 113. The box-like receptacle portion 103 has a bottom wall 105 connected to the bottom 110 of the connecting portion 102 longitudinally and forwardly (leftwardly as viewed in FIGS. 8 and 9) therefrom, a pair of side walls 107,107' standing substantially upright from both side edges of the bottom wall 105, and an upper wall consisting of a pair of upper wall parts 111,111' extending toward each other from the upper edges of the side walls 107 and 107'. The bottom wall 105 and the upper wall 111,111' in combination constitute a first pair of opposing walls of the receptacle portion 103, while the side walls 107 and 107' in combination constitute a second pair of opposing walls of the receptacle portion 103.

The structural features of the second embodiment stated above are identical to those of the first embodiment. The second embodiment, however, is distinguished from the first embodiment in the following points. Namely, in this second embodiment, slits 106,106' are formed in the side walls 107,107' constituting the second pair of opposing walls. More specifically, each slit 106 or 106' is formed in the corresponding side wall 107 or 107' by cutting to extend from the front end (left end as viewed in FIG. 9) rearwardly over a predetermined length, at the widthwise (up and down direction as viewed in FIG. 9) bisector of the side wall. These slits 106 and 106' are substantially aligned with each other. A single contactor 109 extends from the front end of the bottom wall 105. This single contactor is projected from the front end of the bottom wall 105 and then bent upwardly and rearwardly at a bent portion 108 so as to extend into the receptacle portion 104. As will be clearly seen from FIG. 9, the portion of the contactor 109 between the bent portion 108 and the free end 112 is provided at substantially mid portion thereof with an upward protrusion **109*a* which is bent to protrude upwardly. The protrusion 109*a* takes a level higher than the level of the slits 106, 106' and, more specifically, the level above the level of the lower edges of the slits as viewed in FIG. 9**.

The clearance of each slits 106 or 106' formed in the side wall 107 or 107' is gradually increased toward the front end so that a guide portion 115 or 115' similar to that 15 or 15' in the first embodiment is formed by the front end portion of the slit. The clearance ($t_2'$) of the slit 106 or 106' is greater than the thickness ($t_1'$) of the electric contactor 113.

As in the case of the first embodiment, the electric connector of the second embodiment can receive at its receptacle portion 103, i.e. the slits 106,106' various male electric contactors of a large variety of widths to achieve an electric connection therewith. Also, the box-like structure of the receptacle portion 103 ensures a sufficient rigidity of the electric connector.

As in the case of the first embodiment, the female electric connector 101 of the second embodiment is housed by a connector housing similar to that shown in FIG. 6 when it is used actually.

As will be seen from the foregoing description, the female electric connector of the present invention can advantageously make an electric connection to various male electric contactors of a large variety of widths, particularly male electric contactors having such large widths as can never be perfectly accommodated by the receptacle portion of the female electric connector.

What is claimed is:

1. A female electric connector having an electric wire connecting portion and a receptacle portion connected to the front side of said electric wire connecting portion, wherein the receptacle portion includes: a bottom wall connected to the front end of said electric wire connecting portion and extending forwardly therefrom; a pair of side walls standing substantially upright from both side edges of said bottom wall; an upper wall including a pair of upper wall parts extending from the upper edges of both side walls toward each other and opposing to said bottom wall, said upper wall, side walls and bottom wall having substantially same length and cooperate to define therewithin a space of substantially rectangular cross-section, said side walls constituting a first pair of opposing walls of said receptacle portion while said bottom wall and said upper wall constituting a second pair of opposing walls of said receptacle portion; a pair of slits formed in either one of said first pair of opposing walls and said second pair of opposing walls and extending rearwardly from the front ends of said opposing walls over a predetermined length substantially in alignment with each other; and at least one resilient contactor connected to the front end of at least one of said walls constituting the other pair of opposing walls, said resilient contactor having a front end portion projecting by a small length from said at least one wall and being bent inwardly of said receptacle portion, and a main portion having a large length and extending longitudinally and rearwardly into said space in said receptacle portion, said resilient contactor being adapted to make, when a male contactor is inserted into said slits, a resilient contact with said male electric connector to hold the same stably in said slits.

2. A female electric connector as claimed in claim 1, wherein the inner edges of said upper wall parts oppose to each other with a small gap to define therebetween one of said pair of slits, while the other of said slit is formed in said bottom wall to extend longitudinally and rearwardly from the front end of said bottom wall; and wherein said resilient contactor is provided in duplicate, one of said resilient contactors being extended from the front end of one of said side walls and bent backwardly to extend rearwardly in said receptacle while the other resilient contactor extends from the front end of the other side wall and bent backwardly to extend rearwardly in said receptacle portion, the rearwardly extending portions of said resilient contactors facing with each other such that the clearance therebetween converges gradually in the region between the front ends thereof to a predetermined point along the length thereof, such that a wedge-shaped gap is formed between said rearwardly extending portions of said resilient contactors.

3. A female electric connector as claimed in claim 1, wherein said pair of slits are formed in said pair of side walls constituting said second pair of opposing walls to extend rearwardly from the front ends of said side walls over a predetermined length, and wherein only one resilient contactor is provided, said sole resilient contactor being projected from the front end of said bottom wall and bent upwardly and backwardly to extend in said receptacle portion longitudinally and rearwardly, the rearwardly extending portion of said resilient contactor being provided at a predetermined portion thereof with an upward protrusion formed by bending said rearwardly extending portion toward said upper wall, the protrusion protruding at least to the level of said slits.

* * * * *